US005478014A

United States Patent [19]

Hynds

[11] Patent Number: 5,478,014

[45] Date of Patent: Dec. 26, 1995

[54] METHOD AND SYSTEM FOR HOT AIR SPRAY COATING AND ATOMIZING DEVICE FOR USE THEREIN

[76] Inventor: James E. Hynds, 30946 Sunderland, Farmington Hills, Mich. 48331

[21] Appl. No.: 230,076

[22] Filed: Apr. 20, 1994

[51] Int. Cl.[6] ..... B05B 1/24; B05B 12/00

[52] U.S. Cl. ..... 239/135; 239/288.5; 239/397.5; 239/DIG. 14; 239/290

[58] Field of Search ..... 239/124, 126, 239/132, 132.1, 135, 128, 288.5, 290, 296, 397.5, DIG. 14, DIG. 17

[56] References Cited

U.S. PATENT DOCUMENTS

| | | | |
|---|---|---|---|
| 2,980,786 | 4/1961 | Chilton | 239/135 |
| 3,776,462 | 12/1973 | Payne, Jr. | 239/134 |
| 3,796,376 | 3/1974 | Farnsteiner . | |
| 4,132,357 | 1/1979 | Blackinton | 239/135 |
| 4,667,084 | 5/1987 | Regge . | |
| 4,669,661 | 6/1987 | Otto | 239/132.1 |
| 4,761,299 | 8/1988 | Hufstetler et al. | 427/27 |
| 4,785,996 | 11/1988 | Ziecker et al. . | |
| 4,925,101 | 5/1990 | Konieczynski et al. | 239/8 |
| 4,964,569 | 10/1990 | Stevens | 239/13 |
| 5,076,469 | 12/1991 | Pleuse et al. | 222/146.2 |
| 5,102,484 | 4/1992 | Allen et al. . | |
| 5,265,801 | 11/1993 | Larson | 239/135 |
| 5,312,042 | 5/1994 | Larson | 239/135 |

FOREIGN PATENT DOCUMENTS

| | | | |
|---|---|---|---|
| 3501446 | 7/1986 | Germany | 239/135 |
| 0042032 | 3/1984 | Japan . | |
| 1577858 | 7/1990 | U.S.S.R. | 239/135 |

*Primary Examiner*—Karen B. Merritt
*Attorney, Agent, or Firm*—Brooks & Kushman

[57] ABSTRACT

A spray gun uses hot, high volume, low pressure (HVLP) air to atomize a coating material at a spray head of the gun. The coating material may be water-based adhesive or paint which may include a relatively small amount of solvent. The coating material may also be a high viscosity, solvent-based paint such as a polyester or urethane. The spray gun includes a plunger mechanism and a trigger which generate an air pressure control signal which opens a valve to allow the hot HVLP air to come to the front of the spray gun. Thermally insulated hot air hoses couple the spray gun to a source of hot air such as a heater conversion unit. Teflon tubes thermally insulate the coating material from the hot air as the coating material is received by the spray gun. A plastic shroud thermally insulates and concentrates a hot air coating material mixture during atomization of the coating material at a spray head of the spray gun. The hot air has a temperature in the range of 250° F. to 350° F. at the spray head so that a substantial portion of the base of the coating material is evaporated from the atomized coating material before coating an article. When the coating material is a water-based adhesive, the water-based adhesive dries in about the same amount of time that it takes for a solvent-based adhesive to dry in a conventional spray coating system.

39 Claims, 4 Drawing Sheets

METHOD AND SYSTEM FOR HOT AIR SPRAY COATING AND ATOMIZING DEVICE FOR USE THEREIN

TECHNICAL FIELD

This invention relates to methods and systems for air spray coating and atomizing devices for use therein and, in particular, to methods and systems for air spray coating and atomizing devices for use therein wherein the air has a relatively high flow rate, a relatively low delivery pressure (i.e. HVLP) and a relatively high temperature at a spray head of the atomizing device to atomize and help dry a coating material.

BACKGROUND ART

Many state and federal agencies require that all products produced with ozone-depleting substances such as solvents be labeled as such. These same agencies also will not allow new adhesive spray installations to be installed without very expensive solvent burners to clean recirculate solvent-laden air.

One solution to this problem is to switch from solvent-based adhesives to water-based adhesives which contain little or no solvents. When a water-based adhesive is applied by conventional or high volume, low pressure (HVLP) guns, tremendous processing problems result such as longer "tack time." This is also called "green strength."

With solvent-based adhesives, an operator could process his/her parts very quickly due to quick solvent evaporation. With water-based adhesives, there is a significant waiting time between spray and process. This is due to the water which must be evaporated. Most water-based adhesives are 30% to 50% water by weight. For example, an 8 lb. gallon of water-based adhesive contains 2½ lbs. to 4 lbs. of water. A substantial portion of the water must be evaporated before "tack" is achieved.

Operations such as repairing foam cushions, sticking pieces of foam together, applying fabric, etc. can easily take 3 to 5 times longer with water-based adhesive if no assist is given to the process. Many plants have attempted to install special heating units in order to dry the water-based adhesive and to trap water under the surface. Even with additional ovens, processing time is increased dramatically. Many mechanical means have been attempted. Hot air guns similar to hair dryers have been used after spraying water-based adhesive with a conventional gun. This doubles operator application time.

All of these measures require more capital investment by increasing the length of processing lines, adding more ovens and establishing accumulating areas for the parts. More operators are needed as well to keep up with line speeds.

U.S. Pat. No. 4,761,299 discloses a method and apparatus for spray coating an article in a coating zone with a liquid coating material, such as paint, wherein air is supplied to the spray head of an air spray gun at an atomizing air flow rate in excess of 5 CFM and at a delivery pressure of less than 15 psi to atomize the liquid coating material. A turbine unit filters and heats the air so that the air has a temperature in excess of 70° F. at the spray head. However, this temperature is not high enough to properly dry a water-based adhesive.

Japanese Patent Document JA 9,042,032 discloses, in its translation, a hot air atomizer for helping to disperse suspended liquid such as a watery liquid. The atomizer is a non-air atomizing rotary bell or disk. Material is atomized by electrostatic centrifugal means and air is used for shaping only. The hot air is used to lower viscosity of thick materials which have a tendency to block fluid dispensing openings. Air temperature is 100° to 120° F.

U.S. Pat. No. 4,667,084 discloses an adhesive spray gun system that uses an electrically heated hot air system for atomizing a melted adhesive. A heater hose heats both hot melt adhesive and atomizing air. A hot melt adhesive is 100% solids in block form. It is then melted into a thick liquid for application. The purpose of the hot air is to keep the hot melt from drying in the hose or on the gun.

U.S. Pat. No. 5,102,484 discloses an adhesive spray system using a hot gas, such as hot air, to keep the adhesive soft prior to working. There is no mention of atomizing hot melt viscous material. Hot gas at the applicator head keeps viscosity down and assist in swirling the patterns but the hot gas does not mix with the material.

U.S. Pat. No. 4,964,569 discloses a warm air spray system for preventing the formation of condensation in its supply and return lines. Warm air under high pressure is used in "any desired spray device." The purpose is to reduce condensation in atomizing lines.

U.S. Pat. No. 4,669,661 discloses a hot melt glue sprayer that uses heated air to ensure that the hot melt sprays efficiently and accurately. A hot melt glue gun uses high pressure hot air to keep glue soft and applicable.

U.S. Pat. No. 3,776,462 discloses a sprayer for molten metal that uses heated air under pressure to atomize the spray. Hot air heats metal to keep it molten. High pressure air "propels atomized particles at high velocity onto the surface to be coated."

U.S. Pat. No. 4,785,996 discloses an adhesive spray system that uses a plunger mechanism for allowing adhesive to be released into a spray cavity. High pressure cold air is used to divert "bead of extruded hot melt adhesive."

U.S. Pat. No. 3,796,376 discloses a spray gun that has a trigger actuated plunger to control the flow of liquid. High pressure cold air is emitted through a special valve/plunger mechanism in the handle of the gun.

U.S. Pat. No. 5,076,469 discloses a spray gun system that uses a heated gas to ensure a better application of hot melt adhesives or the like. The gun uses an electrical resistance heater to keep hot melt adhesive molten. Compressed gas (air) is heated under high pressure.

U.S. Pat. No. 4,925,101 discloses a wax spray gun that uses an operating plunger mounted with an air valve to allow atomizing air to be admitted to the wax. Cold atomizing air is used under high pressure.

SUMMARY OF THE INVENTION

An object of the present invention is to provide a method, system and hot air atomizer for use therein which solves the problems of the prior art by allowing quick dry or "tack times." The atomizer mixes hot HVLP air with the coating material and drives or evaporates a base of the coating material out quickly before coating an article. When the coating material is a water-based adhesive, processing times for the water-based adhesive is similar to that for a solvent-based adhesive.

In carrying out the above object and other objects of the present invention, a method is provided for hot air spray coating an article with a coating material including a base. The method includes the steps of supplying hot air to an atomizing device having a spray head and supplying the coating material to the atomizing device. The method also includes the step of thermally insulating the hot air from the coating material to prevent polymerization of the coating material and utilizing the hot air entering the atomizing device to atomize the coating material to obtain atomized coating material including the base at the spray head. The hot air has a flow rate in excess of 5 CFM at the spray head, a delivery pressure of less than 15 psi over atmospheric pressure at the spray head, and a temperature in excess of 200° F. at the spray head to evaporate a substantial portion of the base from that atomized coating material before coating the article.

Preferably, the delivery pressure at the spray head is in the range of 2–12 psi over atmospheric pressure, the flow rate at the spray head is in excess of 15 CFM, and the temperature of the hot air at the spray head is in the range of 250° F. to 350° F.

Also, preferably, the base may be water, a solvent, or a mixture of water and solvent.

Further in carrying out the above object and other objects of the present invention, a system is provided for carrying out each of the above method steps.

Still further in carrying out the above object and other objects of the present invention, an atomizing device for use in the above method and system is provided. The atomizing devices includes a body, a spray head mounted on the body, an input coating passage for receiving a coating material including a base, and a separate input air passage for receiving hot air. The atomizing device also includes means for thermally insulating the hot air from the coating material to prevent polymerization of the coating material within the atomizing device. The hot air atomizes the coating material at the spray head to obtain atomized coating material including the base. The hot air has a flow rate in excess of 5 CFM at the spray head, a delivery pressure of less than 15 psi over atmospheric pressure at the spray head, and a temperature in excess of 200° F. at the spray head to evaporate a substantial portion of base from the atomized coating material before coating the article.

The advantages accruing to the method, system and atomizing device described above are numerous. For example, when the coating material is a water-based adhesive, the adhesive is dried in about the same amount of time that it takes for a solvent-based adhesive to dry in a conventional spray coating system. Also, there is no need to provide special heating units to dry the water-based adhesive.

The advantages of the present invention will be readily appreciated as the same can be better understood by reference to the following detailed description when taken in connection with the accompanying drawings.

BEST MODE FOR CARRYING OUT THE INVENTION

Figure 1:
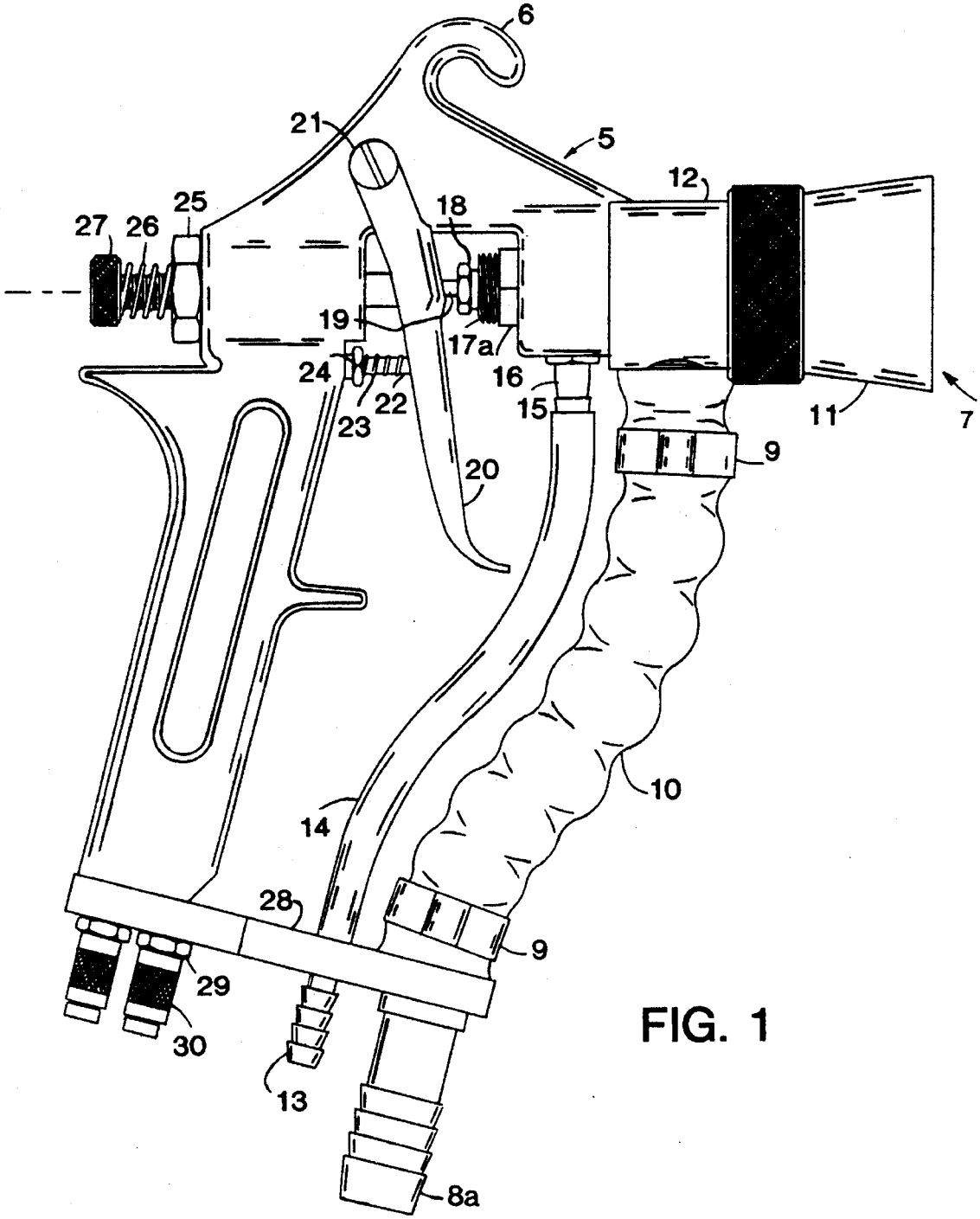
FIG. 1 is a side elevational view of an atomizing device for use in the method and system of the present invention.
Figure 2:
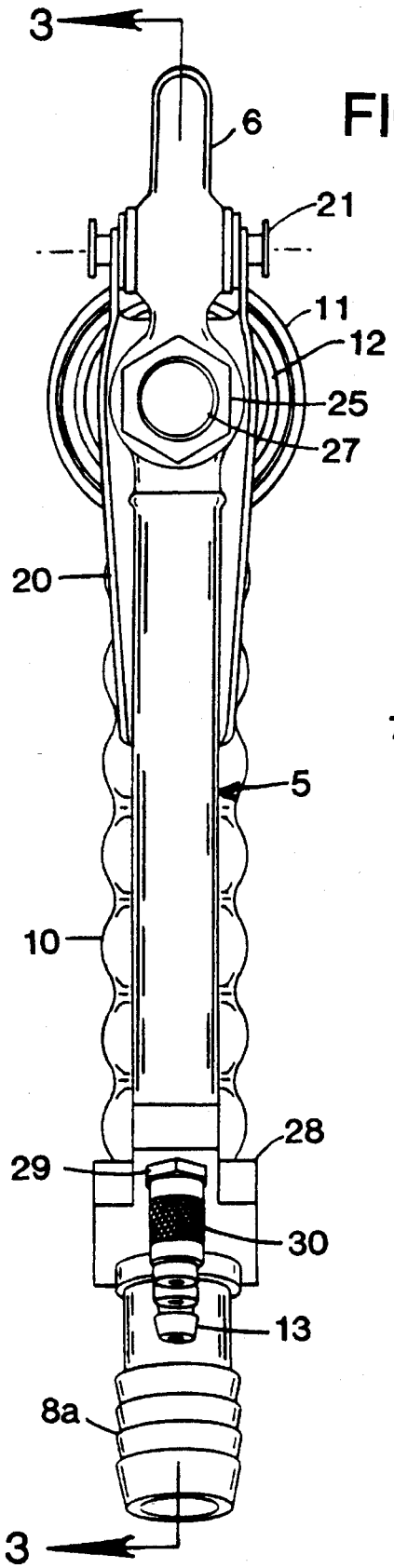
FIG. 2 is a rear elevational view of the atomizing device of FIG. 1.

Referring now to the drawings figures, there is illustrated in FIGS. 1 through 5 a hot air spray gun method and system which utilizes high volume, low pressure (HVLP) hot air to atomize and apply a coating material such as a water-based adhesive to a substrate in such a way so as to dry the water-based adhesive quickly. The method and system may also be utilized with a water-based paint which, like the water-based adhesive, may include a small amount of solvent. Also, the coating material may be a solvent-based, high viscosity (i.e. high solid) paint such as a polyester or urethane.

The method and system utilize an atomizer or atomizing device such as the spray gun illustrated in the drawing figures. The spray gun may be either of the manual or automatic type. Both types are preferably made of lightweight machinable plastic which makes the atomizer both ergonomic and robot friendly. In other words, the atomizer is lightweight.

The atomizer typically includes a gun body, generally indicated at 5, which has an integrally formed gun hook 6, for supporting the atomizer. The atomizer also includes a spray head including air cap, generally indicated at 7, which is also preferably made from machinable plastic to provide thermal insulation and prevent accidental burns. In general, the air cap 7 is specially designed to use high volume, low pressure (HVLP) hot air and direct the hot air toward the water-based adhesive. Also, air temperature is preferably in the range of 250° F. to 350° F. at the air cap. The volume of the hot air is preferably in the range of 25 to 35 CFM and the static pressure is preferably in the range of 4 lbs. to 10 lbs. per square inch (psi).

Figure 5:
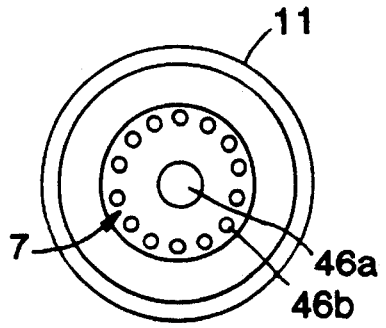
FIG. 5 is a front elevational view of a spray head of the atomizing device.

Referring now to FIG. 5, the air cap 7 includes a central hole **46*a* and circumferentially spaced holes 46*b* which are sized and angled to correctly atomize the adhesive and give desirable particle size. Also, the air cap 7 prevents material build-up which can distort the fan and cause interruption of material flow. Preferably, the central atomizing hole 46*a* is in the range of 4 millimeters to 8 millimeters in diameter. Also, preferably, the fanning holes 46*b* are in the range of 3 millimeters to 7 millimeters in diameter. The fanning holes 46*b* can either be in opposing relationship or assume a circle pattern around the atomizing hole 46*a* as illustrated in FIG. 5. Obviously, the various configurations of the fanning holes 46*b*** can supply a round pattern of adhesive or a flat pattern depending on application requirements.

The air cap 7 also preferably includes an air cap shroud 11 which is threadedly secured to a gun collector 12 of the spray head. The shroud 11 surrounds the holes **46*a* and 46*b* and thermally insulates the spray head of the atomizer by holding in hot air and prevents the hot air from dissipating. The shroud 11 also helps to concentrate the drying effect of the hot air. The shroud 11** is particularly useful when the method, system and atomizer device are utilized for foam repairs.

Preferably, if the air cap 7 has any metal portions, they are Teflon-coated to allow the atomizing device to be easily cleaned.

The atomizer device also includes barb fittings **8*a* and 8*b*, one of which extends through gun bracket 28. The barb fittings 8*a* and 8*b* cooperate with spaced, hot air hose clamps 9 to secure a pair of hot air hoses 10 to the atomizing device. One of the hot air hoses 10 extends between the gun bracket 28 and the gun collector 12**.

Figure 3:
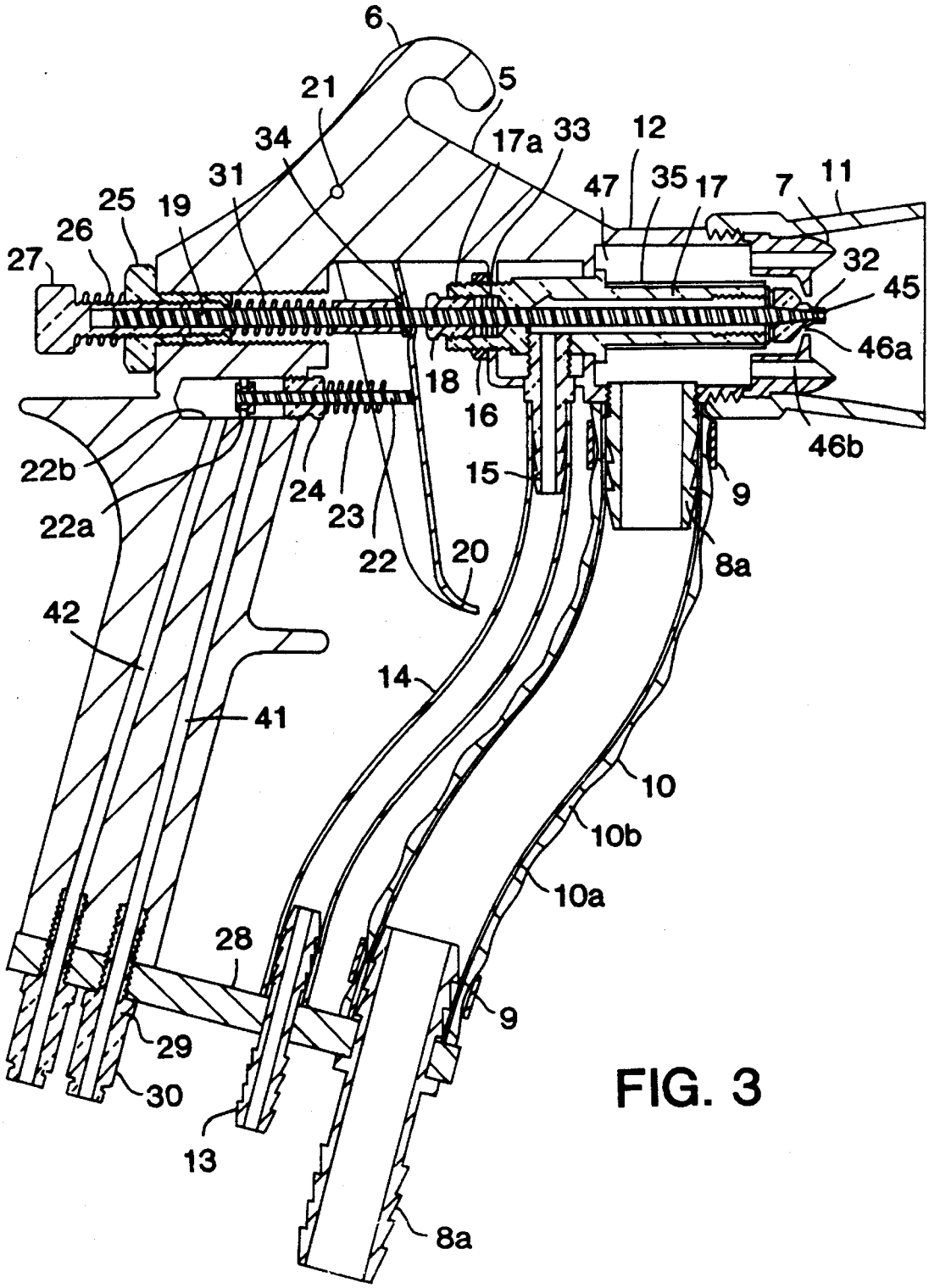
FIG. 3 is a sectional view of the atomizing device taken along lines 3—3 of FIG. 2.

As illustrated in FIG. 3, each of the hoses 10 preferably comprises a special lightweight flexible insulated hose having an internal diameter of approximately ¾ inch to carry the high volume of heated air from a heater conversion unit 38 to the atomizer device. The hose 10 preferably comprises a relatively rigid inner layer 10*a* to keep the hose 10 from collapsing and an outer glass insulated sheath 10*b* which keeps the heat from the heated air from escaping from the hose. Such escaping heat might cause polymerization of the water-based adhesive in a fluid hose 14. Preferably, the insulated sheath 10*b* can withstand hot air up to 500° F.

An atomizing pressure air inlet or passage defined by the inlet barb fitting 8*b* is also preferably approximately ¾ inch in diameter so that pressure into the atomizing device is substantially the same as the pressure at the exit of the air cap 7. One advantage of this relatively low pressure is that the glue particles in the water-based adhesive have a lower velocity and stay on top of foam pieces when foam pieces are being repaired, rather than being forced into recesses of the foam where no contact can be made.

The atomizer also includes a fluid barb fitting 13 which also extends through the gun bracket 28. A collector barb fitting 15 is threadedly secured to the atomizing device at one end thereof and at the opposite end thereof receives thereover the fluid hose 14 which extends between the barb fittings 13 and 15. The barb fitting 15 helps define an input coating passage in the collector 12. The fluid hose 14 conveys the water-based coating material or adhesive to the collector 12.

As can be readily appreciated, the fluid hose 14 is thermally insulated from the hot air hose 10 so that the hot atomizing air does not prematurely set the liquid-based adhesive therein.

The atomizing device also includes a collector nut 16 which secures a collector fluid tube, generally indicated at 17 in FIG. 3, within the gun body 5. The collector nut 16 is threadedly secured at a threaded portion 17*a* of the fluid tube 17 which extends from the gun body 5. Preferably, the collector fluid tube 17 is machined from plastic to further insulate the water-based adhesive from the hot air within the atomizer.

A packing nut 18 supports a plastic gun needle 19 which extends in the material coating passage of the collector fluid tube 17 to control the flow of water-based adhesive therethrough. Packings 33 fluidly seal and support the gun needle 19 within the collector fluid tube 17. The gun needle 19 also extends through a gun trigger 20 which is pivotally mounted on the gun body 5 at gun trigger axle 21.

The gun trigger 20 engages a plunger mechanism 22 which is biased by a plunger spring 23. A plunger nut 24 supports the plunger mechanism 22 and is threadedly inserted into a handle portion of the gun body 5. The plunger mechanism 22 includes a piston 22*a* which is sealingly, slidably mounted within an aperture 22*b* formed in the handle portion of the gun body 5.

The handle portion of the gun body 5 includes the plunger mechanism 22 with a high pressure air supply line extending in and out therefrom. This provides a control signal in the form of an air impulse (when the gun trigger 20 is pulled back) to a recirculating valve 43 which is typically located near the operator of the atomizing device. Normally, hot air is diverted or bled off at an exhaust portion 44 of the valve 43 when the atomizing device is not in use, thereby preventing the escape of hot air from the air cap 7. This feature saves power, cuts noise, and reduces the chance that an operator may be burned. The same advantage can be achieved by hanging the atomizing device on a shut-off valve or bleeder on the side of a spray booth. Both shut-off bleeder mechanisms allow very hot air to stay close to the operator and ready for use when needed.

A female spring stop 25 is threadedly secured in one end of the gun needle 19 and abuts the gun body 5. A spring 26 extends between a male needle stop portion 27 of the gun needle 19 and the female spring stop 25. A needle spring 31, as illustrated in FIG. 3, extends about the gun needle 19 and between the female spring stop 25 and a needle washer 34. The needle washer 34 abuts against an inside surface of the gun trigger 20.

A plastic hollow tip 32 is threadedly secured to the collector fluid tube 17 and also houses one end of the gun needle 19. The water-based adhesive exits the fluid tube 17 at an opening 45 in the tip 32.

A nylon outer fluid tube shield and a nylon inner fluid tube shield collectively indicated at 35 in FIG. 3, are provided about the collector fluid tube 17 to thermally insulate the hot air from the water-based adhesive to prevent polymerization of the water-based adhesive in the atomizer device. In other words, the hot air in a collector passage 47 within the gun collector 12 is thermally insulated by the tube shields 35 and 36 from the water-based adhesive in the fluid tube 17.

The atomizer device also includes a pair of disconnects 30 which are retained to the gun bracket 28 by retaining bracket bolts 29. Threaded portions of the quick disconnects 30 extend into the handle portion of the gun body 5 and are in fluid communication with a recirculating air intake tube 41 and an air outflow tube 42, both of which extend upwardly in the hand portion of the gun body 5 to the aperture 22*b*.

Figure 4:
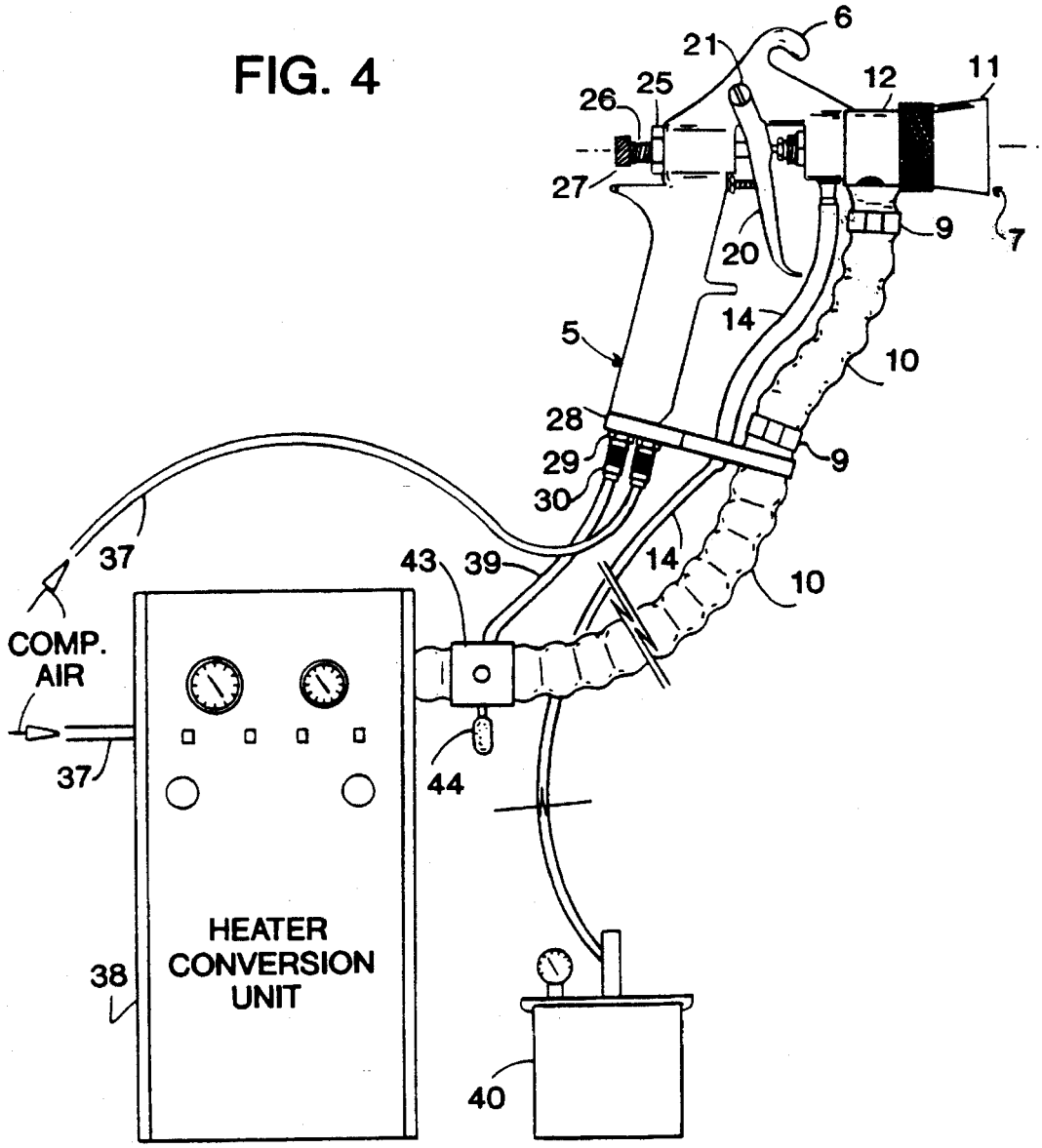
FIG. 4 is a schematic view, partially broken away, illustrating the method and system of the present invention.

As illustrated in FIG. 4, the quick disconnect 30 fluidly coupled to the air intake tube 41 is connected to compressed air hose 37. The quick disconnect 30 fluidly coupled to the air outflow tube 42, in like fashion, is connected to a tube 39 which extends to the recirculating valve 43. The recirculating valve 43 has the exhaust 44 extending therefrom.

The method and system of the present invention preferably includes the heater conversion unit 38 which receives compressed air at a compressed air hose 37 and provides heated HVLP air to the recirculating valve 43. The heater conversion unit 38 preferably includes a heating unit which includes a high volume pressure valve which converts high pressure compressed air into high volume/low pressure (HVLP) air. The unit 38 also preferably includes in-line heaters, a thermocouple, a relay and transformers for heating the air. Preferably, the internal passages of the heater are approximately 1 inch in diameter and the heater exhausts 50 CFM air at 250° to 350° F. If needed, a double in-line heater may be necessary to achieve the relatively high temperature of the air.

Blowers/turbines may assist in supplying a high volume of heated air with less power requirements than compressors. The expelled air from these devices, however, must still be fed to the heating device mentioned above. Typically, exiting temperatures from a turbine or blower device is 170° F. to 225° F. Air at this temperature however is not sufficient by itself to dry water-based adhesives.

A pressure pot 40 supplies the water-based adhesive through a first hose 14 up to the gun bracket 28 and then from the gun bracket 28 through a second hose 14 to the fluid tube 17.

The fluid tube 17, the tip 32 and the gun needle 19 are all carefully insulated so that hot atomizing air does not prematurely set or polymerize the adhesive in the atomizing device. The tube 17 may be insulated both inside and out. Also, the tip 32 and the needle 19 are preferably machined from plastic to prevent heat transfer between the hot air and the water-based adhesive. Otherwise, the atomizing device or gun may be clogged and adhesive delivery may be hampered.

Operation Of The Method, System And Atomizing Device

Initially, hot pressure compressed air is allowed to enter the intake tube 41 in the handle portion of the gun body 5, as illustrated in FIG. 3. When an operator depresses the gun trigger 20 of the atomizer device, the plunger mechanism 22 is engaged which allows compressed air to travel into aperture 22*b* and into the flow tube 42 through disconnect 30 to flow tube 39 to the recirculating valve 43. This impulse of air operates as a control signal to open the recirculating valve 43 so that hot air from the unit 38 enters the recirculating valve 43 and instead of being vented to the exhaust portion 44, it is now diverted by an opening chamber in the recirculating valve 43 which releases the hot air into the air hoses 10, leading up the gun collector 12.

Hot air passes through a collector passage 47 defined by the gun collector 12 and is released through ports 46*a* and 46*b* in the air cap 7.

As the operator continues to depress the trigger 20 of the atomizer device, the trigger 20 engages the fluid needle 19 at the needle washer 34 to open the fluid passage 45 in the fluid tip 32. When this occurs, the water-based adhesive comes up through the fluid hoses 14 to the atomizer device and adhesive enters the central passage in the fluid tube 17 and thereafter exits the atomizing device through the opening 45.

At this point, the hot air is atomizing and heating the water-based adhesive as it is released from the tip 32. As fluid is released through the tip 32, the shroud 11 acts as a dome or thermal insulator to retain the hot air.

When the operator releases the trigger 20, the spring 31 pushes the needle 19 forward until it closes the passage in the tip 32. At this time, the plunger mechanism 22 is still engaged to allow hot air to continue to flow to the atomizer device to dry the coating material.

As the operator fully releases the trigger 20, the plunger spring 23 pushes the plunger mechanism 22 back to its original position which shuts off the tube 42 from the tube 41. Blockage of the tube 42 causes the recirculating valve 43 to close, thereby allowing hot air to again flow through the exhaust portion 44.

As described above, the invention includes a hot air spray method and system which includes a compressor or turbine-type air source, an air heating device which controls the hot air and an atomizer device which mixes the hot air with the water-based adhesive during application. Air supply lines to the atomizer preferably have large internal diameters, are flexible and provide insulation between the hot air and the water-based adhesive. The atomizer device uses a high volume of low pressure (HVLP) hot air to atomize and apply the water-based adhesive to a substrate in such a way as to dry the liquid quickly in approximately the same amount of time that it takes for a conventional solvent-based adhesive to dry in a conventional spray coating system.

Obviously, many modifications and variations of the present invention are possible in light of the above teachings. It is therefore to be understood that within the scope of the appended claims, the invention may be practiced otherwise than as specifically described.

What is claimed is:

1. A method for hot air spray coating an article with a coating material including a base, the method comprising the steps of:

supplying hot air to an atomizing device having a spray head;

supplying the coating material to the atomizing device;

thermally insulating the hot air from the coating material in the atomizing device to prevent polymerization of the coating material; and utilizing the hot air entering the atomizing device to atomize the coating material to obtain atomized coating material including the base of the spray head, the hot air having a flow rate in excess of 5 CFM at the spray head, a delivery pressure of less than 15 psi over atmospheric pressure at the spray head, and a temperature in excess of 200° F. at the spray head to evaporate a substantial portion of the base from the atomized coating material before coating the article.

2. The method as claimed in claim 1 wherein the delivery pressure at the spray head is in the range of 2–12 psi over atmospheric pressure.

3. The method of claim 2 wherein the hot air is supplied to the atomizing device at a supply pressure which is substantially equal to the delivery pressure.

4. The method as claimed in claim 1 wherein the flow rate at the spray head is in excess of 15 CFM.

5. The method as claimed in claim 1 wherein the temperature of the hot air at the spray head is in the range of 250° F. to 350° F.

6. The method of claim 1 wherein the step of thermally insulating is also performed outside of the atomizing device.

7. The method of claim 6 wherein the step of thermally insulating is also performed at the spray head.

8. The method of claim 1 wherein the base ms water.

9. The method of claim 1 wherein the base is a solvent.

10. The method of claim 1 wherein the base is a mixture of water and solvent.

11. A method for hot air spray coating an article with a coating material including a base, the method comprising the steps of:

supplying hot air to an atomizing device having a spray head;

supplying the coating material to the atomizing device;

thermally insulating the hot air from the coating material to prevent polymerization of the coating material; and utilizing the hot air entering the atomizing device to atomize the coating material to obtain atomized coating material including the base of the spray head, the hot air having a flow rate in excess of 5 CFM at the spray head, a delivery pressure of less than 15 psi over atmospheric pressure at the spray head, and a temperature in excess of 200° F. at the spray head to evaporate a substantial portion of the base from the atomized coating material before coating the article; and further comprising the steps of receiving a control signal and controlling the supply of hot air to the atomizing device in response to the control signal.

12. The method of claim 11 further comprising the step of generating the control signal wherein the step of generating includes the step of actuating the atomizing device.

13. The method of claim 12 wherein the step of actuating is performed manually.

14. A system for hot air spray coating an article with a coating material including a base, the system comprising:

an atomizing device having an input coating passage, a separate input air passage and a spray head;

a source of coating material fluidly coupled to the input coating passage of the atomizing device for supplying the coating material to the atomizing device;

a source of hot air coupled to the input air passage of the atomizing device for supplying hot air to the atomizing device; and means for thermally insulating the hot air from the coating material in the atomizing device to prevent polymerization of the coating material in the atomizing device, wherein the atomizing device is capable of atomizing the coating material with the hot air at the spray head to obtain atomized coating material including the base, the hot air having a flow rate in excess of 5 CFM at the spray head, a delivery pressure of less than 15 psi over atmospheric pressure at the spray head, and a temperature in excess of 200° F. at the spray head to evaporate a substantial portion of the base from the atomized coating material before coating the article.

15. The system as claimed in claim 14 wherein the delivery pressure at the spray head is in the range of 2–12 psi over atmospheric pressure.

16. The system of claim 15 wherein the hot air is supplied to the atomizing device at a supply pressure which is substantially equal to the delivery pressure.

17. The system as claimed in claim 14 wherein the flow rate at the spray head is in excess of 15 CFM.

18. The system as claimed in claim 14 wherein the temperature of the hot air at the spray head is in the range of 250° F. to 350° F.

19. The system of claim 14 wherein the means for thermally insulating includes at least one thermally insulated fluid tube shield located in the atomizing device to prevent polymerization of the coating material in the atomizing device.

20. The system of claim 19 wherein the means for thermally insulating includes at least one thermally insulated hot air hose for coupling the source of hot air to the input air passage and for thermally insulating the hot air from the coating material.

21. The system of claim 20 wherein the means for thermally insulating includes a shroud mounted at the spray head to thermally insulate a mixture of the atomized coating material and the hot air at the spray head.

22. The system of claim 14 wherein the base is water.

23. The system of claim 14 wherein the base is a solvent.

24. The system of claim 14 wherein the base is a mixture of water and solvent.

25. A system for hot air spray coating an article with a coating material including a base, the system comprising:

an atomizing device having an input coating passage, a separate input air passage and a spray head;

a source of coating material fluidly coupled to the input coating passage of the atomizing device for supplying the coating material to the atomizing device;

a source of hot air coupled to the input air passage of the atomizing device for supplying hot air to the atomizing device; and means for thermally insulating the hot air from the coating material to prevent polymerization of the coating material, wherein the atomizing device is capable of atomizing the coating material with the hot air at the spray head to obtain atomized coating material including the base, the hot air having a flow rate in excess of 5 CFM at the spray head, a delivery pressure of less than 15 psi over atmospheric pressure at the spray head, and a temperature in excess of 200° F. at the spray head to evaporate a substantial portion of the base from the atomized coating material before coating the article; and further comprising control means for generating a control signal to control the supply of hot air to the atomizing device.

26. The system of claim 25 wherein the atomizing device includes actuating means for actuating the control means to generate the control signal.

27. The system of claim 26 wherein the actuating means is manually operable.

28. An atomizing device for hot air spray coating an article with a coating material including a base, the atomizing device comprising:

a body, a spray head mounted on the body, an input coating passage for receiving the coating material, a separate input air passage for receiving hot air, and means for thermally insulating the hot air from the coating material in the atomizing device to prevent the polymerization of the coating material within the atomizing device, the hot air atomizing the coating material at the spray head to obtain atomized coating material including the base, the air having a flow rate in excess of 5 CFM at the spray head, a delivery pressure of less than 15 psi over atmospheric at the spray head and a temperature in excess of 200° F. at the spray head to evaporate a substantial portion of the base from the atomized coating material before coating the article.

29. The atomizing device of claim 28 wherein the air input passage receives the hot air at a supply pressure which is substantially equal to the delivery pressure.

30. The atomizing device as claimed in claim 28 wherein the means for thermally insulating includes at least one thermally insulating tube shield for thermally insulating the hot air from the coating material in the atomizing device.

31. The atomizing device as claimed in claim 30 wherein the means for thermally insulating includes a thermally insulating hot air hose for thermally insulating the hot air from the coating material outside of the body.

32. The atomizing device as claimed in claim 31 wherein the means for thermally insulating further includes a thermally insulating shroud mounted at the spray head to thermally insulate a mixture of the atomized coating material and the hot air at the spray head.

33. The atomizing device as claimed in claim 28 wherein the base is water.

34. The atomizing device as claimed in claim 28 wherein the base is a solvent.

35. The atomizing device as claimed in claim 28 wherein the base is a mixture of water and solvent.

36. An atomizing device for hot air spray coating an article with a coating material including a base, the atomizing device comprising:

a body, a spray head mounted on the body, an input coating passage for receiving the coating material, a separate input air passage for receiving hot air, and means for thermally insulating the hot air from the coating material to prevent the polymerization of the coating material within the atomizing device, the hot air atomizing the coating material at the spray head to obtain atomized coating material including the base, the air having a flow rate in excess of 5 CFM at the spray head, a delivery pressure of less than 15 psi over atmospheric at the spray head and a temperature in excess of 200° F. at the spray head to evaporate a substantial portion of the base from the atomized coating material before coating the article; and further comprising control means for generating a control signal to control the supply of hot air to the atomizing device.

37. The atomizing device as claimed in claim 36 further comprising actuating means for actuating the control means to generate the control signal, the control signal comprising an air pressure control signal.

38. The atomizing device as claimed in claim 37 wherein the control means includes a plunger mechanism coupled to the actuating means.

39. The atomizing device as claimed in claim 38 wherein the actuating means is manually actuable.

* * * * *